US006311372B1

(12) United States Patent
Wang

(10) Patent No.: US 6,311,372 B1
(45) Date of Patent: Nov. 6, 2001

(54) BUCKLE DEVICE FOR SKATES

(76) Inventor: Xin-Quan Wang, 7F-2, No. 43, Nungan St., Taipei (TW)

( * ) Notice: Subject to any disclaimer, the term of this patent is extended or adjusted under 35 U.S.C. 154(b) by 0 days.

(21) Appl. No.: 09/550,245

(22) Filed: Apr. 14, 2000

(51) Int. Cl.[7] ..... A43C 11/00
(52) U.S. Cl. ..... 24/71 SK; 24/69 SK
(58) Field of Search ..... 24/71 SK, 69 SK, 24/68 SK, 68 B, 68 T, 71 T, 71 ST; 36/50.1, 50.5

(56) References Cited

U.S. PATENT DOCUMENTS 3,634,910 * 1/1972 Keskari ..... 24/69 SK
5,720,084 * 2/1998 Chen ..... 24/68 SK
5,884,370 * 3/1999 Bergamin ..... 24/71 SK
5,974,633 * 11/1999 Sartor et al. ..... 24/71 SK

* cited by examiner

*Primary Examiner*—Robert J. Sandy
(74) *Attorney, Agent, or Firm*—Rosenberg, Klein & Lee

(57) ABSTRACT

A buckle device for skates includes a base on a boot and two lugs extend from the base so as to pivotally connected to a lever member between the two lugs. A tubular member extends from a top of the base and a recess is defined in a top of the tubular member. A protrusion extends from a bottom of the lever member and a strap head is pivotably connected between two legs of the lever member. A toothed strap extends from the strap head and is disengagably connected to an engaging means on the boot. The protrusion is disengagably engaged with the recess in the tubular member.

2 Claims, 4 Drawing Sheets

BUCKLE DEVICE FOR SKATES

FIELD OF THE INVENTION

The present invention relates to a buckle device that has a protrusion extending from a bottom of a lever member and a base on boots has a recess to receive the protrusion when the buckle device is in secure position.

BACKGROUND OF THE INVENTION

A conventional buckle device for skates is disclosed in FIG. 1 and generally includes a base 13 fixedly connected on a boot 101 and the base 13 has two lugs 130 extending from two sides thereof. A U-shaped lever member 12 is pivotably connected between the two lugs 130 by its two legs by a pin 120. A strap head 10 is pivotably connected between the two legs of the lever member 12 by another pin 111. A strap 11 with teeth extends from the strap head 10 and is able to be engaged with an engaging means 30 on the other side of the boot 100. When unfasten the buckle device, the user pulls the lever member 12 about the pin 120 and the strap head 10 will be also pivoted about the pin 111 so as to loosen the strap 11. There is a potential risk that when the lever member 12 is unintentionally impacted, the strap 11 is loosened. In a hockey game, impact between players is so frequent that the lever members are likely lifted during playing the game. Although a locking means 121 is employed to secure the lever member 12, the locking means 121 is located on a distal end of the lever member 12 so that it will be pushed unintentionally.

The present invention intends to provide a buckle device that has a protrusion extending from a bottom of the lever member and the base has a recess on a top thereof so that the protrusion can be securely engaged with the recess in the base to prevent from unexpectable lift.

SUMMARY OF THE INVENTION

In accordance with one aspect of the present invention, there is provided a buckle device for skates and comprising a base having two lugs and a tubular member extending from a top of the base. The tubular member has a recess defined in a top of the tubular member. A lever member has two legs and the two legs are pivotally connected to the two lugs. A protrusion extends from a bottom of the lever member and is disengagably engaged with the recess in the tubular member. A strap head is pivotably connected between the two legs of the lever member and a toothed strap extends from the strap head and is disengagably connected to an engaging means.

The object of the present invention is to provide a buckle device that has a protrusion on the lever member and the protrusion is engaged with a recess in the to base so as to secure the lever member in position.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
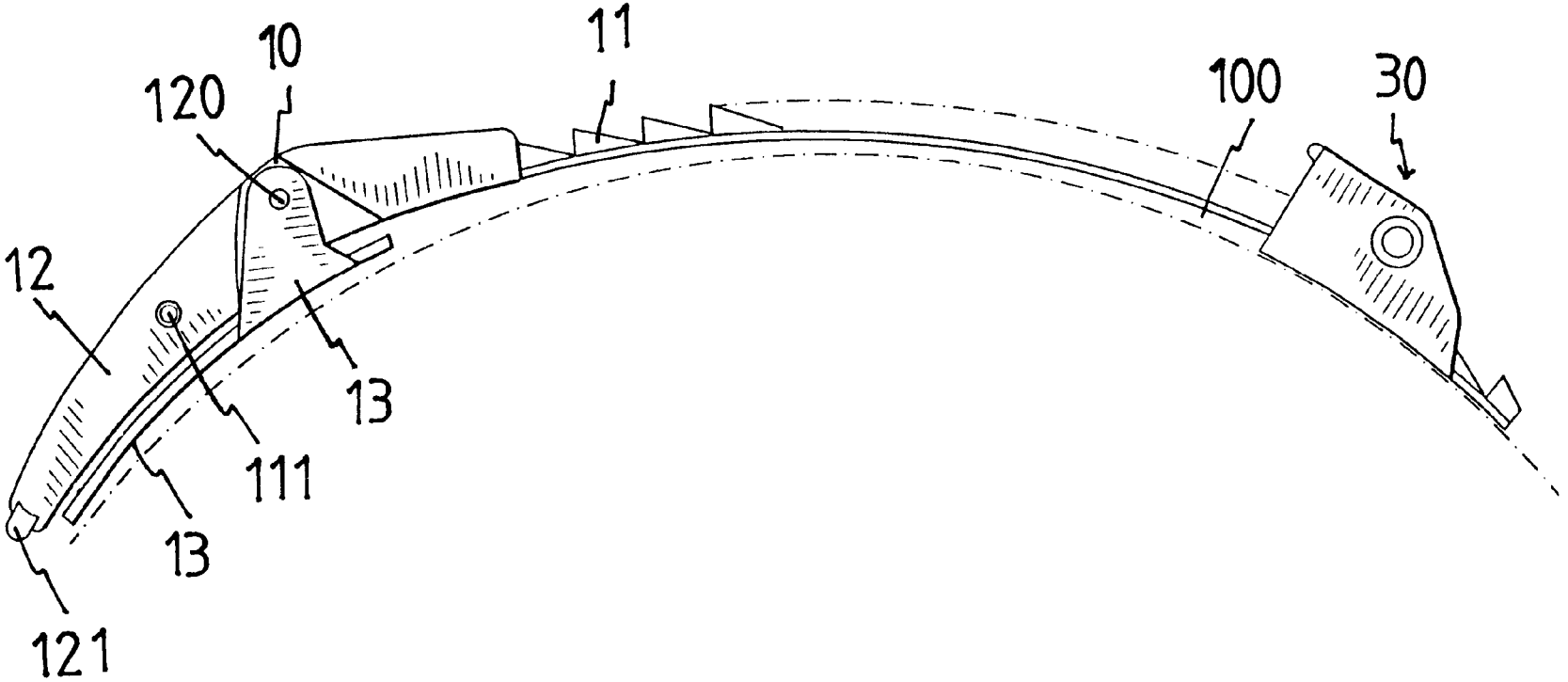
FIG. 1 PRIOR ART
FIG. 1 is a side elevational view to show a conventional buckle device for skates.
Figure 2:
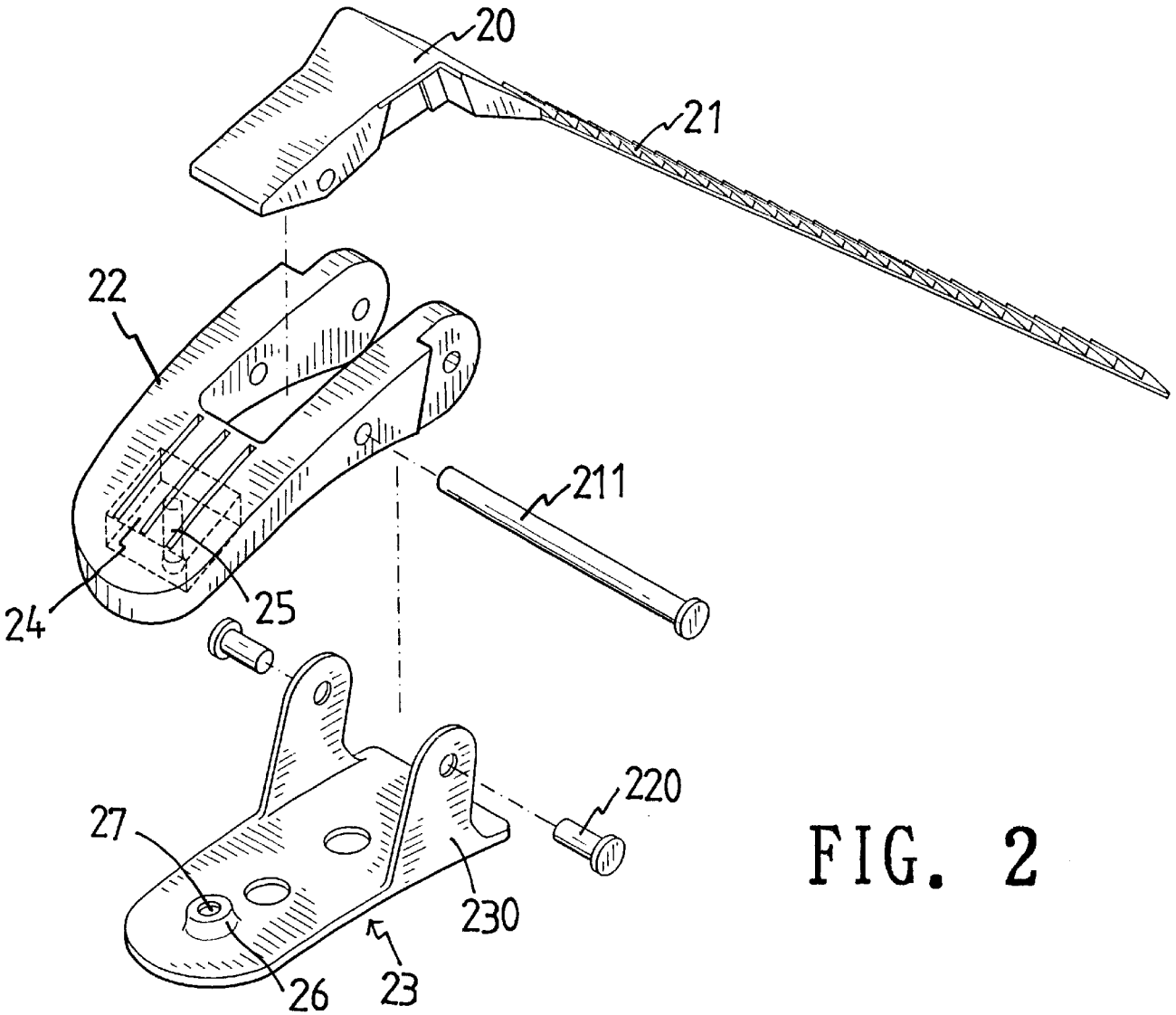
FIG. 2 is an exploded view to show a buckle device of the present invention.
Figure 3:
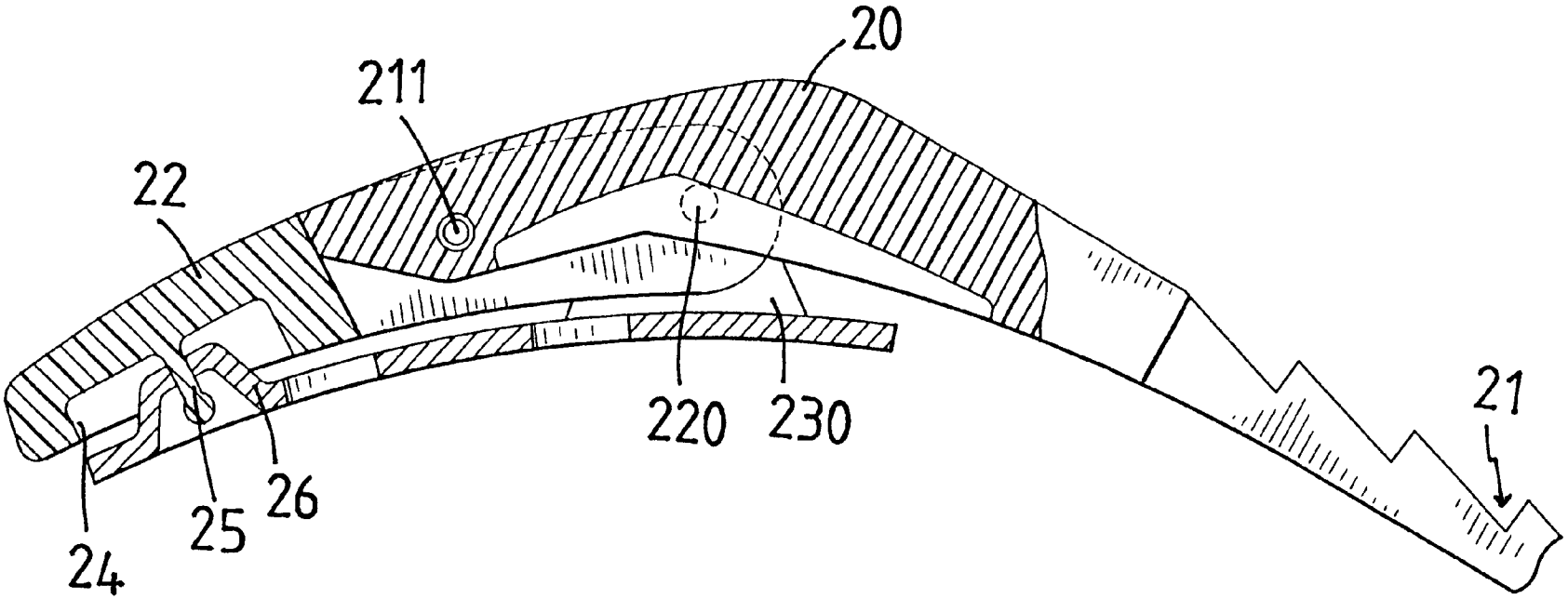
FIG. 3 is a side elevational view, partly in section, of the buckle device of the present invention.
Figure 4:
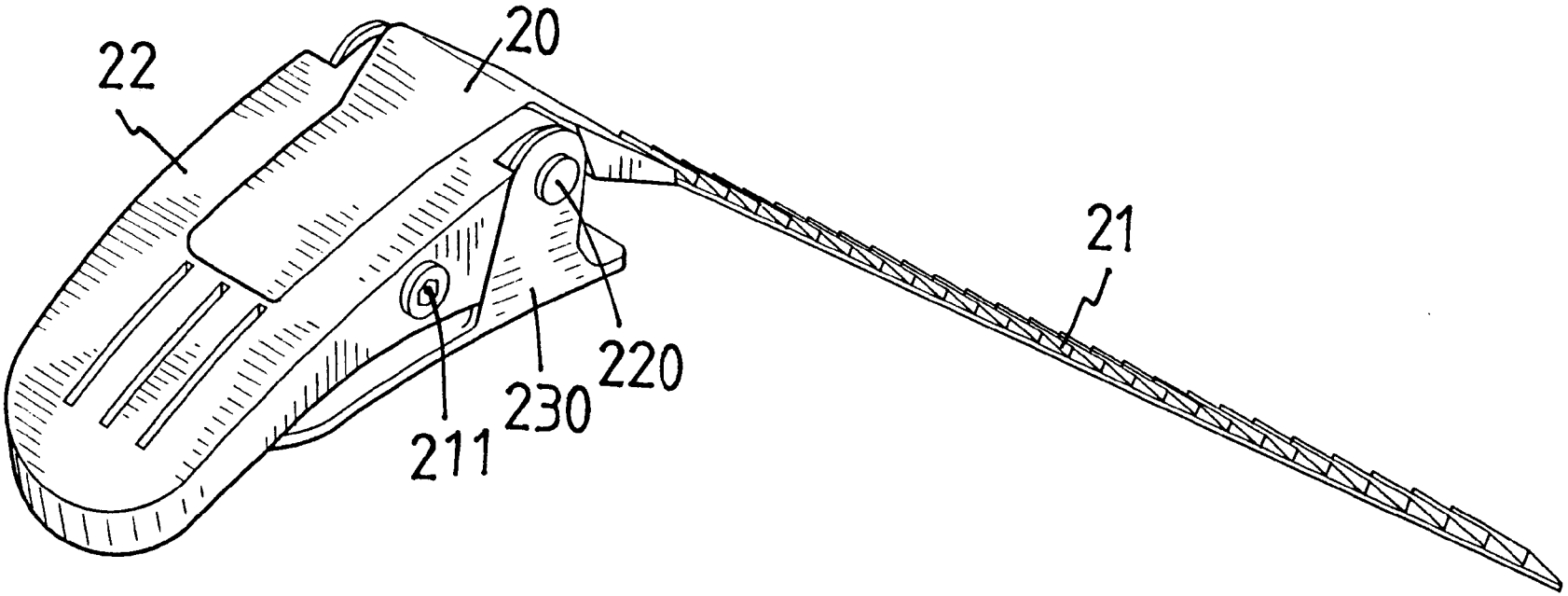
FIG. 4 is a perspective view to show the buckle device of the present invention.

Referring to FIGS. 2 to 4, the buckle device in accordance with the present invention comprises a base 23 fixedly on a boot and having two lugs 230 extending from two sides thereof. A tubular member 26 extends from a top of the base 23 and a recess 27 is defined in a top of the tubular member 26. A U-shaped lever member 22 has two legs and the two legs are pivotally connected to the two lugs 230 by two rivets 220. A recessed area 24 is defined in the bottom of the lever member 22 and a protrusion 25 extends from an inside of the recessed area 24. The protrusion 25 is disengagably engaged with the recess 27 in the tubular member 26. A strap head 20 is pivotably connected between the two legs of the lever member 22 by a pin 211. A toothed strap 21 extends from the strap head 20 and is disengagably connected to an engaging means 30 on the boot.

Therefore, when locking the buckle device of the present invention, a user pushes the lever member 22 downward toward the base 23 to let the protrusion 25 be engaged with the recess 27 in the tubular member 26 so that the lever member 22 is securely positioned to the base 23. When unlocking the buckle device, the user lifts the lever member 22 to loosen the strap 21. The engagement between the protrusion 25 and the tubular member 26 can be made to be tightened that it will not be lifted unintentionally.

While we have shown and described various embodiments in accordance with the present invention, it should be clear to those skilled in the art that further embodiments may be made without departing from the scope and spirit of the present invention.

What is claimed is:

1. A buckle device for skates, comprising:

a base having two lugs extending from two sides thereof and a tubular member extending from a top of said base, said tubular member having a recess defined in a top of said tubular member;

a lever member having two legs and said two legs pivotally connected to said two lugs, a protrusion extending from a bottom of said lever member and disengagably engaged with said recess in said tubular member, and a strap head pivotably connected between said two legs of said lever member, a toothed strap extending from said strap head and disengagably connected to an engaging means.

2. The buckle device as claimed in claim 1 further comprising a recessed area defined in said bottom of said lever member, said protrusion extending from an inside of said recessed area.

* * * * *